United States Patent [19]

Boxer et al.

[11] 4,165,555

[45] Aug. 28, 1979

[54] HOOK-AND-PILE STRIPS FOR SOCKS AND THE LIKE

[76] Inventors: Rubin Boxer; Robert K. Boxer, both of 564 Ricardo Ave., Santa Barbara, Calif. 93109

[21] Appl. No.: 838,827

[22] Filed: Oct. 3, 1977

Related U.S. Application Data

[63] Continuation-in-part of Ser. No. 617,969, Sep. 29, 1975, abandoned, and Ser. No. 632,818, Nov. 17, 1975, Pat. No. 4,058,853.

[51] Int. Cl.[2] ..... A44B 13/00

[52] U.S. Cl. ..... 24/204; 2/DIG. 6; 24/DIG. 29; 428/100

[58] Field of Search .... 24/204 R, DIG. 18, DIG. 29; 428/101, 100; 2/239, DIG. 6, 240

[56] References Cited

U.S. PATENT DOCUMENTS

| | | | |
|---|---|---|---|
| 3,905,062 | 9/1975 | de Navas Albareda | 24/204 X |
| 3,940,873 | 3/1976 | Lawless | 24/204 X |

FOREIGN PATENT DOCUMENTS

| | | | |
|---|---|---|---|
| 968137 | 5/1975 | Canada | 24/204 |

*Primary Examiner*—H. Hampton Hunter

*Attorney, Agent, or Firm*—Fidelman, Wolfe & Waldron

[57] ABSTRACT

A pair of flexible pile patches and flexible hook patches that are hinged together are formed by cutting transversely a strip of flexible material having parallel strips of pile and hooks. An area between the pile and hook strips acts as a hinge, and the outer edges of the strip are clear of hook and pile to serve as tabs for separating the hooks and pile by manually grasping the tabs between thumb and forefinger of each hand. The rear surface of the strip may have an adhesive (preferably, a thermoplastic dry material) for adhering each pair to an article of clothing such as socks, so that the pile and hooks of one sock may be joined to the hook and pile of another sock. This attachment of socks is useful during laundering to avoid later sorting of socks into pairs.

3 Claims, 14 Drawing Figures

HOOK-AND-PILE STRIPS FOR SOCKS AND THE LIKE

This is a continuation-in-part of our prior applications, Ser. No. 617,969, filed Sept. 29, 1975, now abandoned, and Ser. No. 632,818 filed Nov. 17, 1975, now U.S. Pat. No. 4,058,853, issued Nov. 22, 1977, both having the title "Socks With Flexible Self-Contained Fastener Patches."

This invention relates to pairs of apparel items, such as socks, and has particular reference to an improved fastening structure for holding such pairs together as during laundering, etc.

Various attempts have been made over the years to relieve housewives and others of the chore of matching up sock pairs after laundering. Various types of clips have been used to hold pairs together. Others have used pins that pierce both socks of a pair. These have proved unsatisfactory, because they are usually not conveniently available when the wearer discards his socks for the laundry. Other solutions have been sought by using separate pockets in mesh bags which can be bodily immersed in a washing machine. Another attempt is illustrated by U.S. Pat. No. 3,688,348 to Klotz, wherein special bands are wrapped around the shanks of sock pairs to keep them together during washing. Such bands have the same disadvantage of lack of availability at the time of discarding socks.

Other attempts have been made by placing snaps or hook-and-eye fasteners on sock pairs. These, too, have their drawbacks. Snaps and hook-and-eye fasteners are usually metallic or otherwise stiff and unyielding as the socks are tugged and pulled during washing. This tends to increase local stresses, resulting in local stretching near the fasteners and sometimes tearing the sock fabric. Also, they have a more serious disadvantage of being uncomfortable to the wearer if local pressure is placed on the sock as by crossing the legs. This causes the stiff fasteners to press into the flesh, and this pressure becomes uncomfortable. In the case of metallic mechanical fasteners, bending and deformation can sometimes occur in severe washing.

Another attempt has been made with the use of tie strings. While these, too, are instantly available if sewed to sock pairs, they are cumbersome and have proved to be unsatisfactory.

We have found a combination of socks and self-contained fasteners that operates satisfactorily. We found that the objections to prior art fasteners may be avoided by the use of flexible patches that can be placed directly on the socks and which patches adhere to each other when pressed together. While several materials fall into this category, we presently prefer fasteners of the hook-and-pile type generally sold under the trademark of Velcro and described in U.S. Pat. Nos. 3,000,384 and 3,009,235. This type of fastener holds up in repeated washings, even with very hot water, and retains its holding power over long periods of time. Flexible sticky patches to accomplish this same result give difficulty in having other garments stick to the patches, and the patches lose their stickiness with repeated washings. The hook-and-pile material presently preferred is very flexible and comes in sheets or strips that can be cut to size and then adhered or sewn to the socks.

The hook patches tend to adhere to some materials such as fuzzy trouser materials, and, while this temporary bond is easily broken, it may annoy some users. We have found that this adhering tendency may be avoided by placing a patch of pile material over the hook patch. The pile patch is preferably hinged to the hook patch and may be opened for bonding, which additionally doubles the bonding area.

Various objects, advantages, and features of the invention will be apparent in the following description and claims considered together with the drawings forming an integral part of this application and in which:

Figure 1:
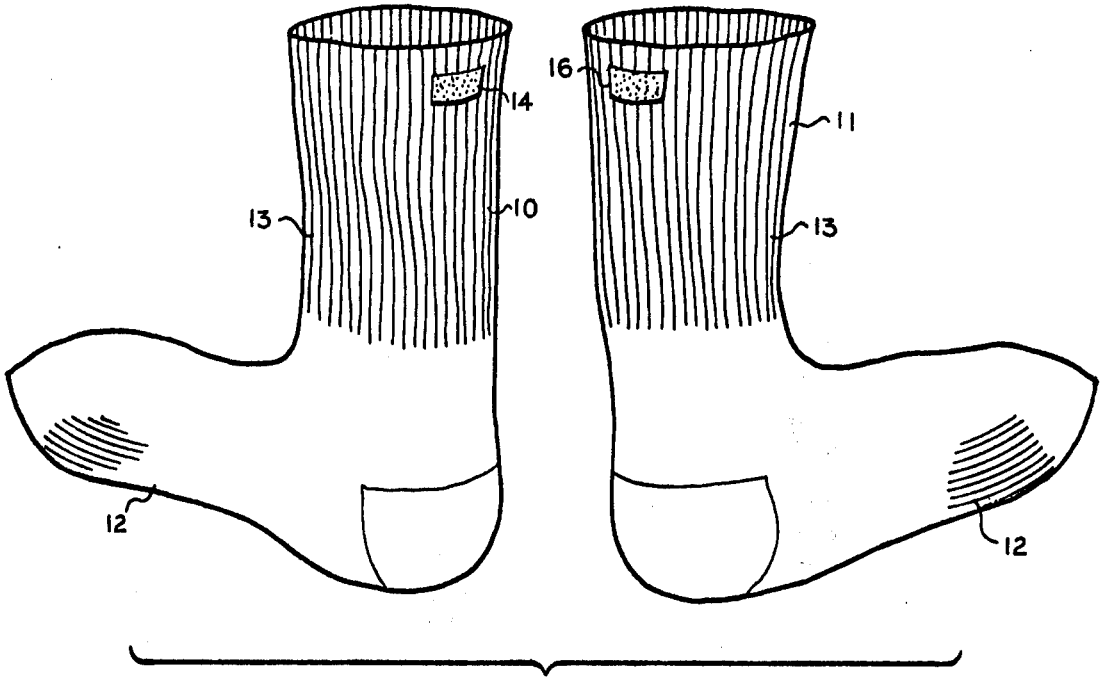
FIG. 1 is a three-dimensional view of a pair of separated socks having fastener patches secured to the socks.

Referring to FIG. 1, there is illustrated a pair of socks 10 and 11, each having a foot section 12 and a shank section 13. Disposed on each sock 10 and 11 are fastener patches 14 and 16, respectively. These patches may be placed anywhere on the sock for the purpose of holding a sock pair together, but we have determined that there is a minimum interference with pant legs and minimum visibility if the patches 14 and 16 are placed at the rear of the shank and toward the top of the shank.

The patches 14 and 16 are selected particularly in accordance with our invention to be flexible, and the closer the patch material can approach the flexibility of the fabric of the socks, the more effective are the patches. If stiff fasteners such as snaps are used, the sock fabric is stretched out of shape and sometimes torn. Our flexible fastener patches, by contrast, flex with the sock fabric during washing and thereby prevent such local stresses. Furthermore, our flexible patches are comfortable to the wearer, and local pressure on the legs will not produce painful impressions, but instead will be smooth and comfortable.

Figure 2:
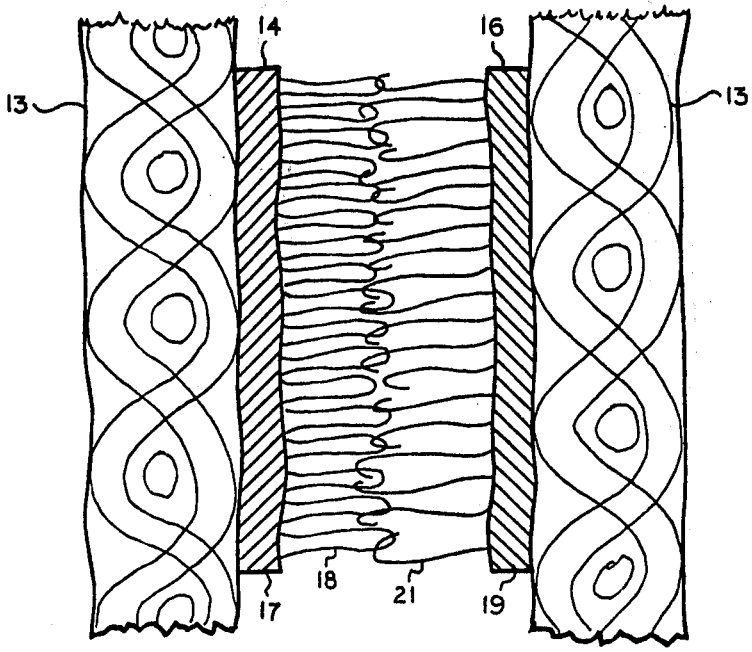
FIG. 2 is a sectional view through the fabric of the socks and the patches when the patches are secured together, thereby holding the socks of the pair.

While various types of flexible adhering patches 14 and 16 may be used, we have found that the most durable and satisfactory is the hook-and-pile type previously mentioned, sold under the trademark "Velcro." This type of material has mating halves with hooks on one part and pile on the other. When manually pressed together, they adhere with good pressure per square inch so that a rather strong tug is required to separate them. Such a structure is shown in enlarged section in FIG. 2, wherein the patch 14 consists of a flexible base 17 from which projects pile 18. The patch 16 consists of a flexible base 19 from which project hooks 21. The hooks engage the pile when pressed together to hold the two patches together and thereby hold the socks together.

Various means may be employed to secure the patches 14 and 16 to the sock shanks 13. We have used sewing with good results. Coating the surfaces of bases 17 and 19 with a thermoplastic permits ironing the patches to the socks, especially when the hooks and pile are joined together. Cold adhesives may be used, particularly flexible epoxy cements.

We have found that when socks are washed with heavy items such as sheets and towels in an automatic or other power washer, considerable stress is placed on the patches 14 and 16. We have used patches of about one-quarter to one-half square inch successfully.

We have found that the hook patches of one sock tend to momentarily stick to the user's trousers, especially if the trouser material is very fuzzy. For example, if the wearer of such trousers happens to cross his legs to place pressure on the exposed hooks of the hook patch, there is a weak adherence of the fuzzy material to the hook patch. While this bond is easily broken, it may become annoying to some. We have found that this may be avoided by placing a cover over the hook patch. This cover may be of a material that sticks to the hooks. We have found, however, that the best results are obtained by using a cover of pile material from the hook-and-pile combination. To make sure that this cover is always available, we connect it directly to the hook patch. With this objective, the cover is hinged to the hook patch, but can be joined in any other fashion. When the cover is closed on the hooks, only the smooth fabric backing of the cover is exposed and trousers do not stick to it.

We have further found that both socks of a pair may be provided with a hook patch and a pile cover, and when both are opened up to expose both cover and patch, the hooks of one sock can engage the pile of the other and vice versa, to double the bonding area when the two socks are joined together for laundering, etc. In this fashion, for example, a quarter square inch of hook patch can have a quarter square inch of pile cover hinged to it to provide half a square inch of joining surface. As mentioned previously, we presently prefer about one-quarter to one-half square inch of joining surfaces to withstand the rigors of clothes-washing machines.

It will be apparent that it is immaterial which of a hinged pair of hook-and-pile patches is secured to the socks and which is the cover for the other. We presently prefer to secure the pile to the sock, in which case the hinged area of hooks becomes the "cover."

Figure 3:
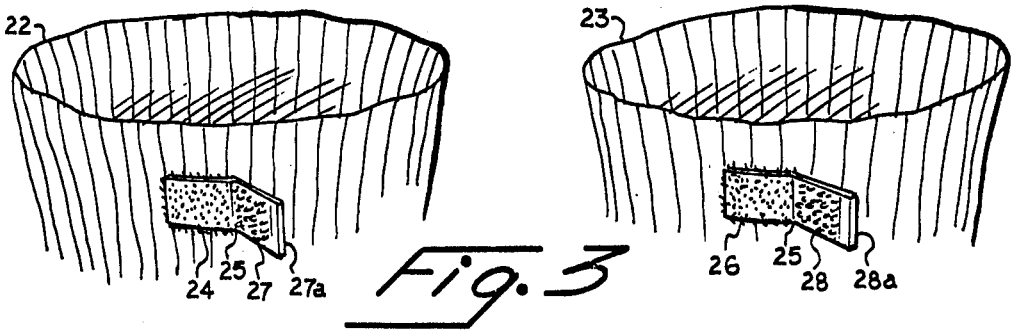
FIG. 3 is a three-dimensional fragmentary view of the tops of a pair of socks, each having a pile and hook patch joined together, one of which is fastened to each sock.
Figure 4:
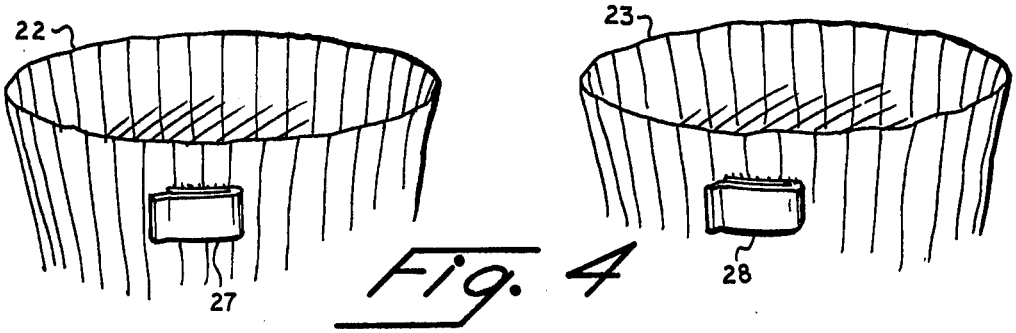
FIG. 4 is a three-dimensional fragmentary view of the sock tops of FIG. 3 showing the top closed upon the secured patch to present a smooth fabric exterior for each hook-and-pile pair.
Figure 5:
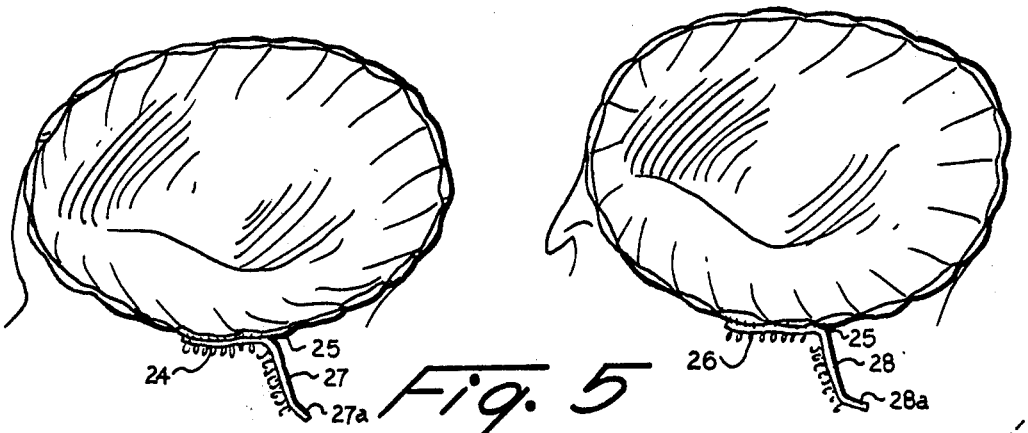
FIG. 5 is a top view of the socks of FIG. 4, showing the hinged or integral relationship of each hook-and-pile pair.

Referring to FIGS. 3, 4, and 5, secured to each sock 22 and 23 of a pair of socks is a patch of pile 24 and 26, respectively. Hinged at 25 to pile patches 24 and 26 are hook patches 27 and 28, respectively. The hinge may be formed of the fabric backing upon which the pile and hooks are woven, or the hook patches 27 and 28 may be sewed to the pile patches, in which case the threads may act as the hinge or part of the hinge. The outermost edge of the hook patches 27 and 28 may be free of hooks as at **27*a* and 28*a*. This gives a nonadhering part of the hook patch, which may be grasped by the user to pull the patch pairs 24–27 and 26–28** apart. The provision of such a tab is optional.

FIG. 3 shows the patch pairs 24–27 and 26–28 opened up as for joining the socks together for laundering. In this event the hook patch 28 of sock 23 is joined to the pile patch 24 of sock 22 and the pile patch 26 of sock 23 is joined to the hook patch 27 of sock 22. The hinged nature of the patch pairs 24–27 and 26–28 is illustrated in FIG. 5 in a partly closed condition. When each patch pair 24–27 and 26–28 is adhered to itself, the condition is shown in FIG. 4, and only the fabric backing of hook patches 27 and 28 is visible. This fabric backing is smooth and will not catch on clothing. The closed patch pairs 24–27 and 26–28 are fairly flexible and will conform to the curvature of the wearer's legs.

OPERATION OF FIGS. 3 THROUGH 5

Referring to FIG. 5, the wearer of the socks 22 and 23 closes the hook patches 27 and 28 on the pile patches 24 and 26 by rotating them clockwise about their hinge strips 25. The clear fabric backing of the hook patches is then outermost as shown in FIG. 4, and these smooth outer fabrics of patches 27 and 28 will not catch on the pant legs or other clothing of the user.

When the user removes his socks 22 and 23, he manually grasps the tab areas **27*a* and 28*a* (FIGS. 3 and 5) of the patches 27 and 28 and gives them a smart pull, which then separates them from the pile patches 24 and 26. They are then in the open position shown in FIG. 3. The user then pushes the patches of the two socks together, hook patch 28 joining with pile patch 24 and hook patch 27 joining with pile patch 26**. The socks can then be laundered and after laundering and drying will still be joined together. They may then be placed in the dresser drawer.

When next it is desired to use them, the tabs **27*a* or 28*a* of one sock are manually grasped and pulled while holding onto the other sock. The patches then are separated and the socks are ready for wearing after closing patches 27 and 28** as described above.

Figure 6:
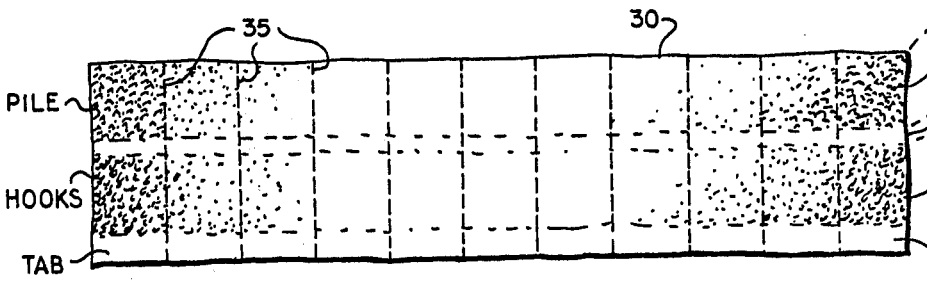
FIG. 6 is a plan view of a strip of material having hook structures on one linear part and pile structures on the other linear part, so that the strip may be transversely cut to form the hook-and-pile pairs of FIGS. 3, 4, and 5.
Figure 7:
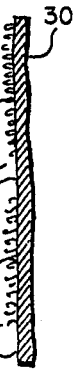
FIG. 7 is an end view on an enlarged scale of the strip of FIG. 6.

Illustrated in FIGS. 6 and 7 is a presently preferred type of factory-made strip from which our patch pairs 24–27 and 26–28 may be formed. A single flexible fabric backing 30 has pile structures 31 sewn or otherwise embedded in the upper part of this fabric strip. Adjoining this pile part is a clear longitudinal area 32, which acts as the hinge area. Adjoining the hinge strip 32 is a lower longitudinal area 33 in which are sewn or otherwise embedded the hook structures of the hook-and-pile combination. The lower edge of the fabric 30 is kept clear to form a tab strip 34.

The factory-made strip of FIGS. 6 and 7 is cut transversely along broken lines 35 to form the pile-hook pairs 24–27 and 26–28 of FIGS. 3, 4, and 5 of any desired width.

Figure 8:
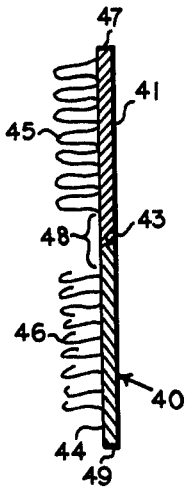
FIG. 8 is a sectional view of a modified form of a hook-and-pile strip wherein separate strips are secured together at adjacent edges.

Shown in FIG. 8 is a modification of the strip of FIGS. 6 and 7. A hook-and-pile strip 40 has an upper strip of flexible backing material 41 and a lower strip of flexible backing material 42. These strips 41 and 42 may be the conventional strips of "Velcro" material presently sold in retail stores having a woven fabric backing usually of synthetic plastic material. These strips 41 and 42 are bonded together by chemical bonding, which process usually employs a solvent or softener so that the material forms a strong unitary and flexible bond 43. Alternatively, adhesives may be employed or heat may be locally applied with or without vibration to form the bond 43 in well-known fashions. In this manner a single unitary or integral strip is formed.

Referring still to FIG. 8, the right side of the composite strip 41–42 may be clear and the left side may have hook-and-pile structures such as piles 45 on strip 41 and hooks 46 on strip 42. The strip 41–42 has an upper edge 47, a clear hinge area 48 on the left side, a clear tab area 44 on the left side, and a lower edge 49.

Figure 9:
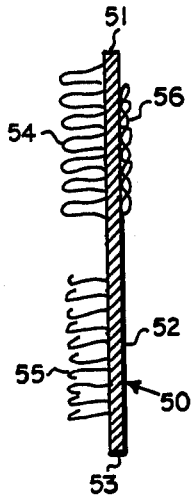
FIG. 9 is a sectional view of a modified form of hook-and-pile strip wherein an adhesive is applied back of one of the hook or pile strips.

Referring to FIG. 9, still another modification is shown wherein an iron-on adhesive is illustrated. A factory-made strip 50 includes a fabric backing material 52 having an upper edge 51 and a lower edge 53. A longitudinal strip of pile 54 is woven or otherwise secured to the upper part of strip 52 and a longitudinal strip of hooks 55 is disposed on the same side as the pile. Disposed on the righthand side, as viewed in FIG. 9, is a longitudinal strip of adhesive 56 for the purpose of securing transverse hook-and-pile pairs to socks or other garments.

While the adhesive 56 may be of any desired type, we presently prefer a dry type in the form of a thin sheet-like tissue paper. This is a thermoplastic material, preferably of the polyamide type, and we lightly adhere it to the backing 52 by controlled heat. We have obtained this material of the type sold under the trademark of "Pellon" and have adhered it to the backing 52 by covering it with a wet cloth and steam-pressing it with a household steam iron (wool setting) for one to three seconds. The steam iron and wet cloth are removed rapidly. This adheres the thermoplastic 56 to later form a strong bond between the backing 52 and a clothing item.

After hook-and-pile pairs are formed of the type created by cutting along lines 35 of FIG. 6, the housewife adheres these to clothing by steam-pressing the sock or glove or other garment material for a period long enough to melt the plastic 56 so that it is embedded in the backing strip 52 and into the texture of the sock, glove, or other garment. Usually a hand pressing of three to ten seconds is sufficient for this purpose, and the "Pellon" instructions of a wet cloth over the material and a minimum of ten seconds of heat give good results. We have found it desirable to rapidly cool the adhered thermoplastic by placing a cold iron upon it or blowing cold air across it. Inasmuch as the hooks and pile are usually formed of thermoplastic material, excessive heat can harm them.

Figure 10:
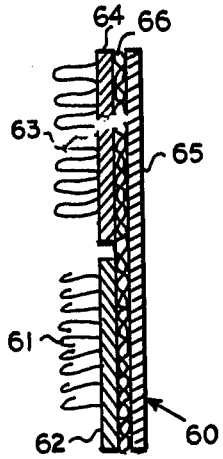
FIG. 10 is a sectional view through a composite hook-and-pile strip wherein a separate hook strip and a separate pile strip are secured to a common backing strip.

Illustrated in FIG. 10 is a composite 60 of a hook strip separate from a pile strip, and both are adhered to a flexible backing. A longitudinal strip of hooks 61 on a backing 62 is placed side-by-side with a strip of pile 63 on a backing 64. Both strips are secured to a single backing strip 65 by the use of an adhesive 66 sandwiched between the composite strips. While any desired adhesive can be used, we have successfully used the polyamide thermoplastic of the "Pellon" manufacture. The piles and hooks sides of the strips 62 and 64 are laid on a work surface or table, a sheet of thermoplastic is next applied, and the backing fabric 65 forms the top layer. Heat applied by steam to the top surface penetrates the backing 65 to melt the thermoplastic 66 and cause it to penetrate the adjoining surfaces to bond them together.

Figure 11:
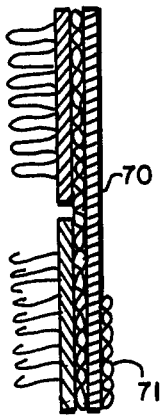
FIG. 11 is a sectional view through a modified form of the invention similar to that of FIG. 10, but wherein an adhesive is applied to the back of one of the hook or pile strips.

Illustrated in FIG. 11 is a modification 70 of the strip of FIG. 10, wherein an adhesive 71 is disposed opposite one of the hook or pile strips. This may be a thermoplastic material as described with reference to FIG. 9 or can be any other desired adhesive.

Figure 12:
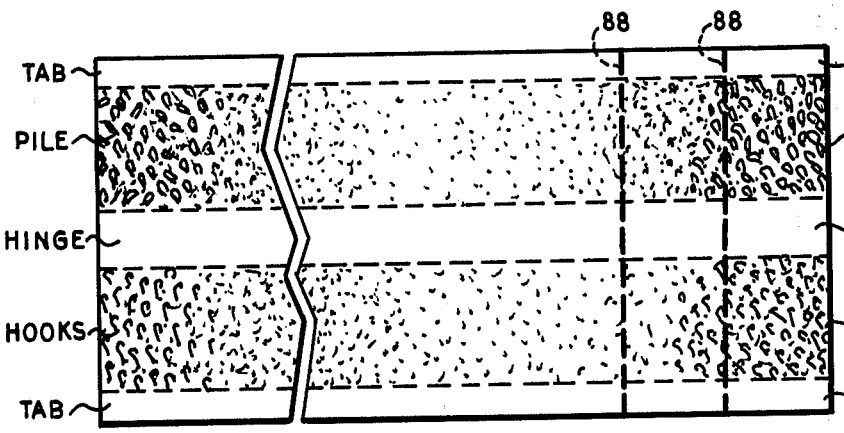
FIG. 12 is a plan view of a hook-and-pile strip wherein there is a tab at each edge and a central hinge area.
Figure 13:
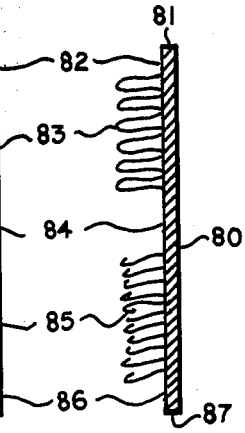
FIG. 13 is an end view of the strip of FIG. 12.

Illustrated in FIGS. 12 and 13 is a modification of the strip of FIGS. 6 and 7 wherein a tab edge is provided at both edges. A strip 80 of backing has a clear surface on the right as viewed in FIG. 13 and a top edge 81 and a bottom edge 87. The other surface has a top tab strip 82, a strip of pile 83, a clear hinge strip 84, a strip of hooks 85, and a bottom tab edge 86. Hook-and-pile pairs are formed from the strip of FIG. 12 by cutting along broken lines 88.

Figure 14:
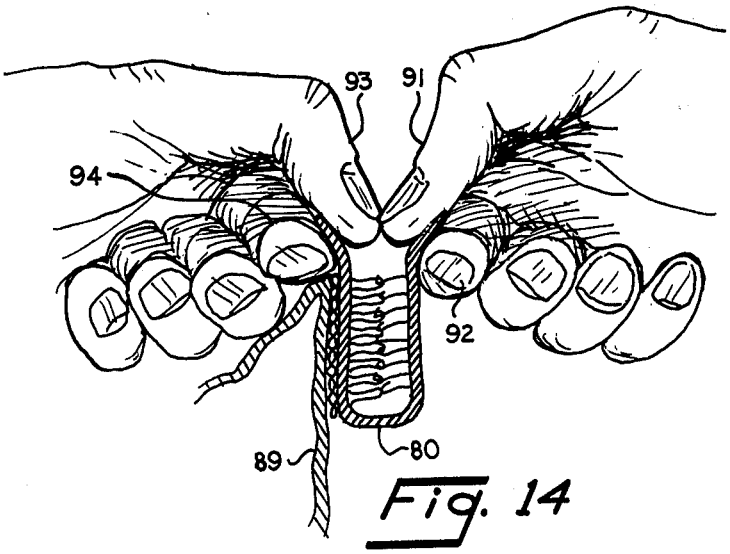
FIG. 14 is an elevation view of a hook-and-pile pair attached to a sock being gripped by the thumbs and fingers of the user to open up the hook-and-pile pair.

The utility of the two tab strips 82 and 86 is illustrated in FIG. 14 wherein one such hook-and-pile pair has its backing opposite the piles secured to a sock 89 in any desired fashion. When the sock is being worn the hook-and-pile strips are fastened together so as not to catch on the inside of the trousers or other clothing being worn at the same time. When the user desires to open this pair for attachment to the hook-and-pile strip on the other sock, he grasps one edge between his thumb 91 and finger 92 of one hand and his thumb 93 and finger 94 of the other hand and pulls them apart. The clear tab edges 82 and 86 (FIGS. 12 and 13) not only provide a gripping area, but they also make it easier to tear the hook-and-pile strip apart because of the starting effect of the tabs.

In addition to avoiding the chore of sock matching after laundering, our flexible patches serve to keep sock pairs and glove pairs, etc., together in dressers without the necessity of wadding one inside the other or using other holding techniques. Our patches are useful to the manufacturer also in avoiding the necessity for packing or clipping each pair to hold the two socks together.

We have described the presently preferred form of our improvement as required by the Rules. We do not limit ourselves to this disclosure as various modifications and variations will occur to those skilled in the art. Included within the following claims are all such modifications and variations that fall within the true spirit and scope of the invention.

We claim:

1. A flexible strip for supplying hook-and-pile patch pairs that engage complementary pile-and-hook pairs for fastening pairs of clothing items together, comprising:

(a) a flat strip of flexible backing material having edges and opposite surfaces;

(b) a first single longitudinal area on one surface of said backing material having pile structures disposed thereon;

(c) a second single longitudinal area parallel to and on the same surface of said backing material, said second area having hook structures disposed thereon;

(d) clear tab areas on both surfaces along at least one common edge, said areas being free of structures;

(e) a flexible, hinge area free of said hook and pile structures between said first and second areas;

(f) and a flexible, adhesive material disposed on that part of the other surface of the flexible backing material that is back of at least one of the first or second area furthest from said tab area;

said hook-and-pile pairs being formed by cutting the strip transversely, and said clear area acting as a tab for pulling the hook and pile apart.

2. The flexible strip in accordance with claim 1 wherein the flexible adhesive material is a polyamide thermoplastic.

3. The flexible strip of claim 1 wherein a second tab area is provided on the side edge opposite said tab area on said one common edge.

* * * * *